US009885312B2

(12) United States Patent
Hirosawa et al.

(10) Patent No.: US 9,885,312 B2
(45) Date of Patent: Feb. 6, 2018

(54) PISTON FOR INTERNAL COMBUSTION ENGINE

(71) Applicants: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

(72) Inventors: Yoshihisa Hirosawa, Kariya (JP); Hitoshi Shimamura, Toyota (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 114 days.

(21) Appl. No.: 14/976,401

(22) Filed: Dec. 21, 2015

(65) Prior Publication Data

US 2016/0186685 A1 Jun. 30, 2016

(30) Foreign Application Priority Data

Dec. 24, 2014 (JP) ..... 2014-260567

(51) Int. Cl.

| | |
|---|---|
| ***F02F 1/00*** | (2006.01) |
| ***F02F 3/04*** | (2006.01) |
| *F02B 77/02* | (2006.01) |
| *B21C 23/08* | (2006.01) |

(52) U.S. Cl.

CPC ..... *F02F 3/042* (2013.01); *B21C 23/085* (2013.01); *F02B 77/02* (2013.01); *F02F 1/004* (2013.01)

(58) Field of Classification Search

CPC .... F02F 3/00; F02F 3/003; F02F 3/042; F02F 3/04

USPC ..... 123/193.4

See application file for complete search history.

(56) References Cited

U.S. PATENT DOCUMENTS

| | | | | |
|---|---|---|---|---|
| 4,488,522 | A * | 12/1984 | Jones | F02F 3/045 123/193.4 |
| 2005/0087166 | A1* | 4/2005 | Rein | C23C 4/16 123/193.4 |
| 2013/0008405 | A1* | 1/2013 | Fiedler | F02F 3/10 123/193.6 |

FOREIGN PATENT DOCUMENTS

| | | | | |
|---|---|---|---|---|
| EP | 0269521 | A2 * | 6/1988 | F02F 3/042 |
| JP | 5993946 | A | 5/1984 | |
| JP | 6-4348 | U | 1/1994 | |
| JP | 2001-304039 | A | 10/2001 | |
| JP | 2010-106724 | A | 5/2010 | |
| JP | 2013-019366 | A | 1/2013 | |

* cited by examiner

*Primary Examiner* — Jacob Amick
*Assistant Examiner* — Charles Brauch
(74) *Attorney, Agent, or Firm* — Sughrue Mion, PLLC

(57) ABSTRACT

A piston for an internal combustion engine includes a piston body. The piston body includes a head, two side walls, two skirts, and a reinforcement member. The head includes a recessed crown. Each side wall includes a pin boss configured to support a piston pin. The two skirts are respectively located at a thrust side with respect to an axis of the piston pin and an anti-thrust side with respect to the axis of the piston pin. The reinforcement member includes two legs and a connecting portion connecting upper ends of the two legs. The two legs are respectively insert-casted in the two skirts. The connecting portion is insert-casted in the head.

6 Claims, 6 Drawing Sheets

PISTON FOR INTERNAL COMBUSTION ENGINE

BACKGROUND OF THE INVENTION

The present invention relates to a piston for an internal combustion engine, and more particularly, to a piston for a cylinder injection (direct injection) type internal combustion engine such as a diesel engine or a gasoline engine that directly injects fuel into cylinders.

A conventional example of a piston will now be described. FIG. 11 is a cross-sectional view showing a combustion chamber of a diesel engine 100. FIG. 12 is a plan view of a piston body 102. As shown in FIG. 11, the diesel engine 100 includes a piston 101 that includes the piston body 102. The piston body 102 includes a head 104, two side walls 109, and two skirts 112. The crown of the head 104 includes a recess 105. Each side wall 109 includes a pin boss 110. The two skirts 112 are respectively located at a thrust side (Th side) and an anti-thrust side (ATh side) with respect to the axis of a piston pin 107. The thrust side (Th side) is the side of the piston 101 forced against the wall of the cylinder immediately after the piston 101 reaches the top dead center. In FIG. 11, the left side of the piston 101 is the thrust side (Th side), and the right side of the piston 101 is the anti-thrust side. The pin bosses 110 support the piston pin 107. An injector 114 is located above the piston 101 to inject fuel toward the recess 105. Japanese Laid-Open Utility Model Publication No. 6-4348 describes an example of such a piston including a piston body with a recessed crown.

The piston body 102 includes a lip 116 defined by the rim of the recess 105 in the head 104. In the power stroke of the diesel engine, the piston 101 receives combustion gas having a high temperature and a high pressure. Thus, referring to FIG. 12, a large tensile stress that acts in the sideward direction of the engine (directions indicated by arrows y1 in FIG. 12) is applied to the lip 116 at the end located toward the engine front (Fr direction) and the end located toward the engine rear (Rr direction). A large pressure stress that acts in the front and rear directions of the engine (directions indicated by arrows y2 in FIG. 12) is applied to the lip 116 at the end located toward the thrust direction (Th direction) and the end located toward the anti-thrust direction (ATh direction). Further, the peripheral portion of the head 104 including the lip 116 is where the temperature of the piston 101 becomes the highest. Thus, the material strength is apt to decrease at this portion. This may form cracks 118 in the crown of the piston body 102 that extend from the Fr direction end and Rr direction end of the lip 116.

In Japanese Laid-Open Utility Model Publication No. 6-4348, a plate formed from copper alloy is coupled to an inner top surface of the piston body. The lower surface of the plate includes fins. The plate, which includes the fins, cools the piston body to prevent the formation of cracks in the crown of the piston body. However, the plate is merely coupled to the inner top surface of the piston body. Thus, the plate does not effectively increase the flexural rigidity of the head in the thrust direction and the anti-thrust direction. Further, the plate does not effectively prevent the formation of cracks in the crown of the piston body.

SUMMARY OF THE INVENTION

It is an object of the present invention to provide a piston for an internal combustion engine that is able to reduce the formation of cracks in the crown of the piston body.

To achieve the above object, a piston for an internal combustion engine includes a piston body. The piston body includes a head, two side walls, two skirts, and a reinforcement member. The head includes a recessed crown. Each side wall includes a pin boss configured to support a piston pin. The two skirts are respectively located at a thrust side with respect to an axis of the piston pin and an anti-thrust side with respect to the axis of the piston pin. The reinforcement member includes two legs and a connecting portion connecting upper ends of the two legs. The two legs are respectively insert-casted in the two skirts, and the connecting portion is insert-casted in the head.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Embodiments of the present invention will now be described with reference to the drawings.

First Embodiment

Figure 1:
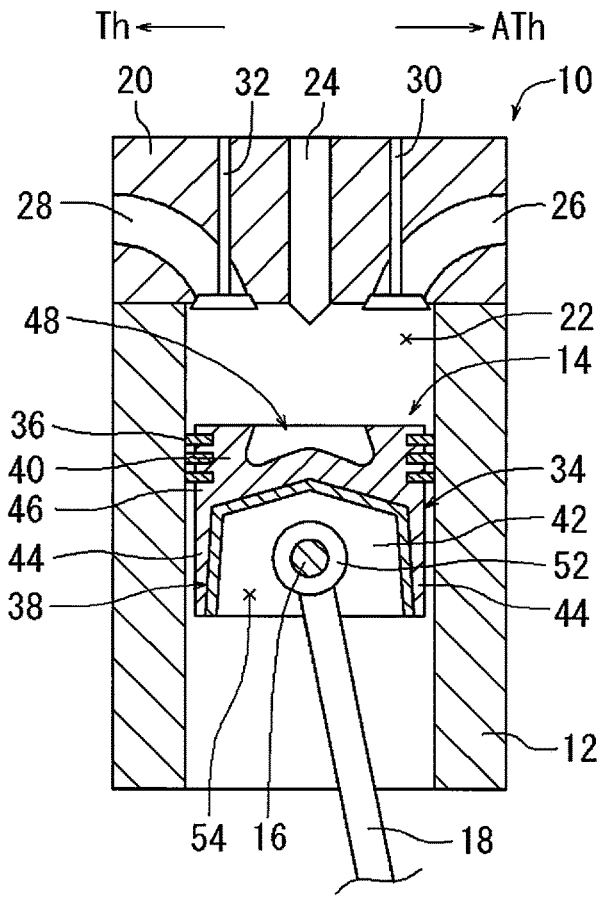
FIG. 1 is a cross-sectional view showing a combustion chamber of a diesel engine in a first embodiment.
Figure 2:
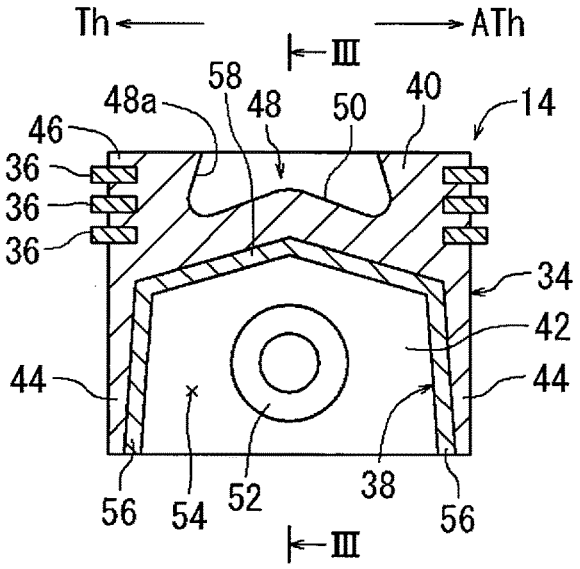
FIG. 2 is a cross-sectional view of a piston shown in FIG. 1.
Figure 3:
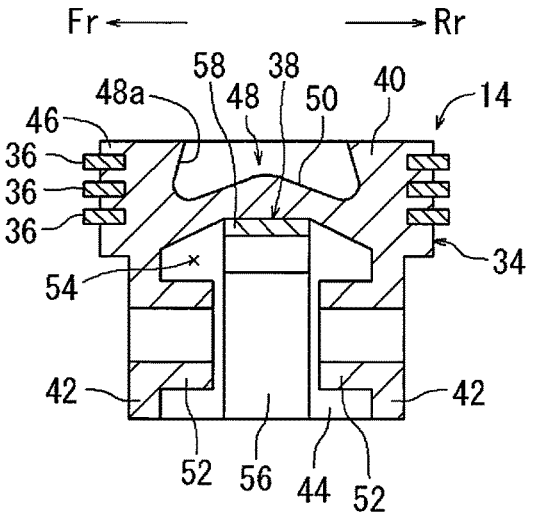
FIG. 3 is a cross-sectional view taken along line III-III in FIG. 2.
Figure 4:
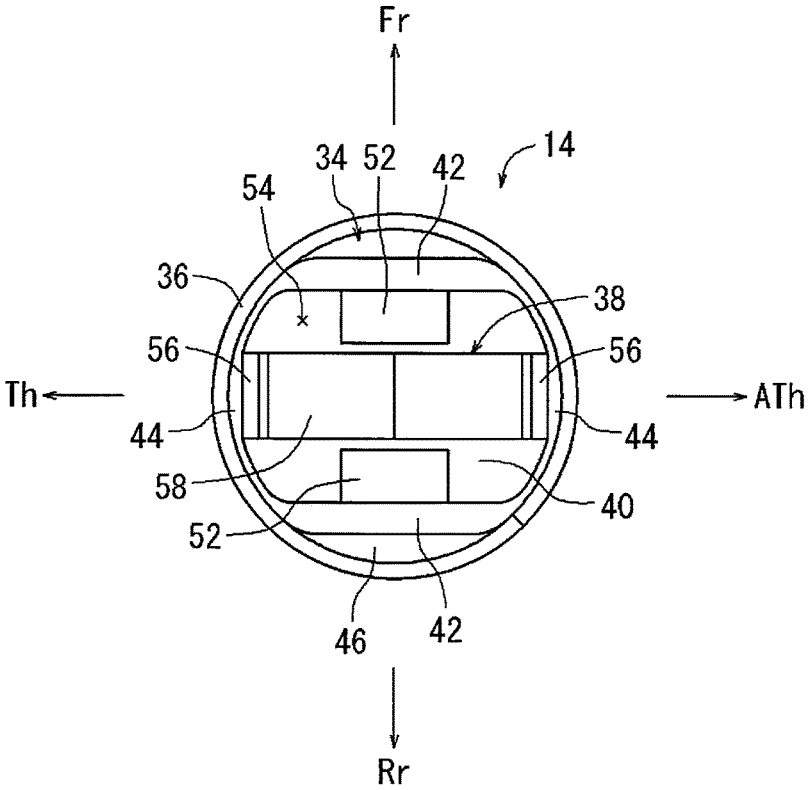
FIG. 4 is a bottom view of the piston shown in FIG. 3.

The present embodiment is applied to a piston 14 for a four-cycle direction injection diesel engine 10 (hereafter referred to as the "diesel engine 10"). FIG. 1 is a cross-sectional view showing a combustion chamber 22 of the engine 10. FIG. 2 is a cross-sectional view showing the piston 14. FIG. 3 is a cross-sectional view taken along line III-III in FIG. 2. FIG. 4 is a bottom view of the piston 14. FIG. 1 shows the piston 14, which is located in one of a plurality of cylinders 12 of the engine 10. In the present specification, the directions in which a piston pin 16 and a crankshaft (not shown) extend are referred to as the engine-front direction (Fr direction) and the engine-rear direction (Rr direction). The directions that are orthogonal to the Fr direction and the Rr direction are referred to as the thrust direction (Th direction) and the anti-thrust direction (ATh direction).

Referring to FIG. 1, the cylinder 12 accommodates the piston 14 in a manner allowing the piston 14 to reciprocate in the vertical direction. The piston pin 16 rotationally couples the piston 14 to a connecting rod 18. A crank pin (not shown) rotationally couples the connecting rod 18 to the crankshaft. A cylinder head 20 is coupled above the cylinder 12. The cylinder 12, the piston 14, and the cylinder head 20 form a combustion chamber 22. An injector 24 is mounted on the cylinder head 20 to inject fuel into the combustion chamber 22. The cylinder head 20 includes an intake port 26 and an exhaust port 28. An intake valve 30 is arranged in the intake port 26 at the end connected to the combustion chamber 22. An exhaust valve 32 is arranged in the exhaust port 28 at the end connected to the combustion chamber 22.

As shown in FIGS. 2 to 4, the piston 14 includes a piston body 34, piston rings 36, and a high-rigidity member 38. The piston body 34 is formed from, for example, an aluminum alloy. The piston body 34 includes a head 40, two side walls 42, and two skirts 44. The peripheral portion of the head 40 extends along a land 46. A plurality of (three in the drawing) piston rings 36 are coupled to the outer circumferential surface of the land 46. The upper two piston rings 36 each function as a compression ring, and the remaining piston ring 36 functions as an oil ring.

As shown in FIGS. 2 and 3, the crown of the head 40 includes a cylindrical recess 48, which has a closed bottom surface. The inside of the recess 48 defines a cavity that is in communication with the combustion chamber 22 (refer to FIG. 1). A side wall surface 48*a* defining the recess 48 has the form of a truncated cone so that the diameter increases toward the bottom surface. The bottom surface of the recess 48 is defined by a gradual and conical projection 50. The side wall surface 48*a* and the projection 50 (bottom surface) are gradually continuous and form an inwardly bulged surface.

As shown in FIGS. 3 and 4, the two side walls 42 are located at the lower side of the head 40 and aligned with each other in the front and rear directions of the engine 10 (Fr and Rr directions). The two side walls 42 are parallel to each other. Each side wall 42 includes a pin boss 52 that supports the piston pin 16 (refer to FIG. 1).

As shown in FIG. 2, the two skirts 44 are respectively located at the thrust side (Th side) and the anti-thrust side (ATh side) with respect to the axis of the piston pin 16. Each skirt 44, which has an arcuate cross-section, is located at the lower side of the land 46 of the head 40. Each skirt 44 includes two ends in the circumferential direction. Each side wall 42 includes two ends in the sideward direction of the engine 10, that is, the Th direction and the ATh direction. Each end of the skirt 44 located at the Th side is continuously connected to the Th end of the adjacent side wall 42, and each end of the skirt 44 located at the ATh side is continuously connected to the ATh end of the adjacent side wall 42 (refer to FIG. 4). When the piston 14 moves in the vertical direction, the two skirts 44 slide along the wall surface of the cylinder 12 (refer to FIG. 1). The head 40, the two side walls 42, and the two skirts 44 define an inner void 54 that is open to the lower side of the piston body 34.

Figure 5:
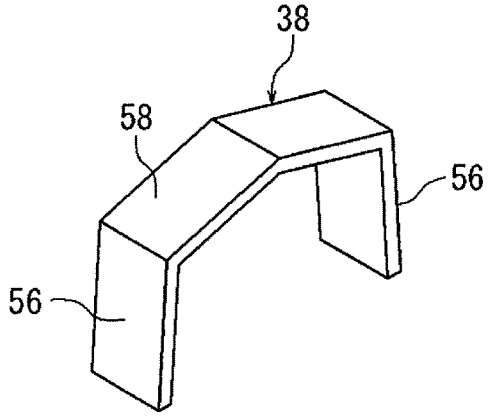
FIG. 5 is a perspective view showing a high-rigidity member.

The high-rigidity member 38 is formed from a metal material having a higher Young's modulus than the material of the piston body 34 (aluminum alloy). The metal material may be steel, such as high-tensile steel or stainless steel. FIG. 5 is a perspective view showing the high-rigidity member 38. As shown in FIG. 5, the high-rigidity member 38 is formed by bending a strip of metal into a U-shaped form. The high-rigidity member 38 includes two legs 56 and a connecting portion 58 connecting the upper ends of the two legs 56. The connecting portion 58 has the form of a reversed V that extends gradually in conformance with the inner surface, or top surface, in the head 40 of the piston body 34. The connecting portion 58 extends in a direction orthogonal to the axis of the piston pin 16 (axis of pin bosses 52).

Referring to FIGS. 2 to 4, the two legs of the high-rigidity member 38 are insert-casted to the inner surfaces of the two skirts 44 in the piston body 34. Further, the connecting portion 58 is insert-casted to the inner surface, or the top surface, in the head 40 of the piston body 34. The inner surface of the high-rigidity member 38, that is, the inner surfaces of the two legs 56 and the lower surface (inner bent surface) of the connecting portion 58 are exposed to the inner void 54 of the piston body 34. The high-rigidity member 38 corresponds to the "reinforcement member" in the present specification. The inner surfaces of two legs 56 of the high-rigidity member 38 and the lower surface of the connecting portion 58 correspond to the "exposed surface" in the present specification. In this manner, the high-rigidity member 38 includes the two legs 56, which are respectively embedded in the two skirts 44, and the connecting portion 58, which is embedded in the head 40. Further, the high-rigidity member 38 includes the exposed surface, which is exposed to the inner void of the piston body 34.

Figure 12:
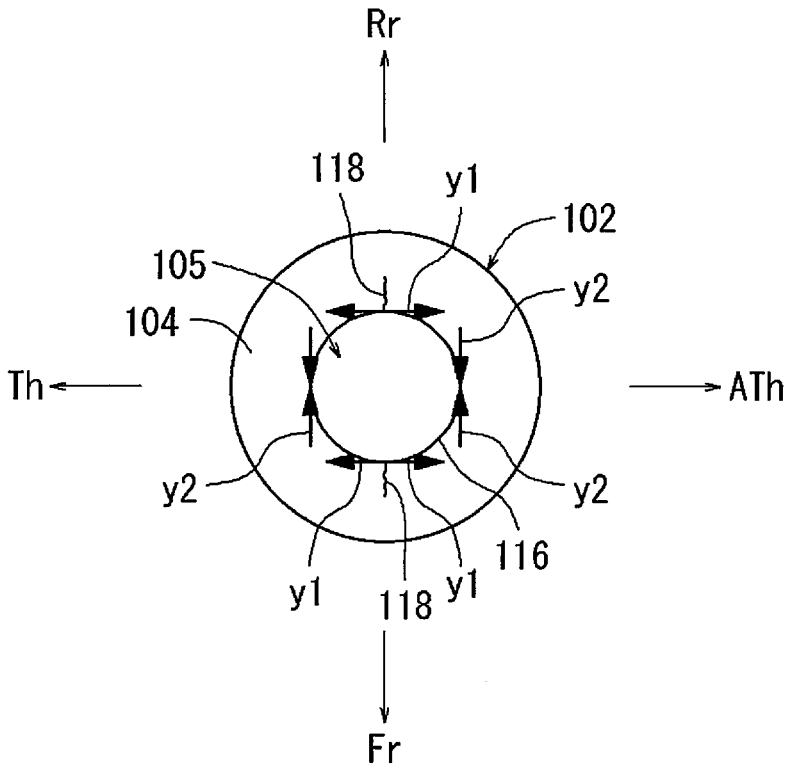
Fig.12 Prior Art
FIG. 12 is a plan view showing a prior art example of a piston body.

In the piston 14, the high-rigidity member 38 in the piston body 34 increases the flexural rigidity of the head 40 in the thrust direction (Th direction) and the anti-thrust direction (ATh direction). Thus, the deformation amount of the head 40 is reduced in the thrust direction (Th direction) and the anti-thrust direction (ATh direction) at the crown of the piston body 34. This reduces the formation of cracks in the crown of the piston body 34 (refer to 118 in FIG. 12).

Second Embodiment

Figure 6:
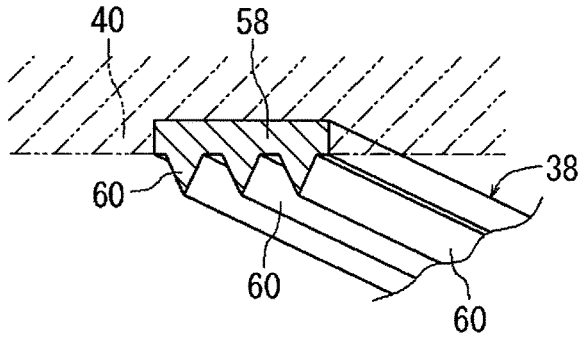
FIG. 6 is a partial perspective view of a high-rigidity member in a second embodiment.

The following description will focus on differences from the first embodiment. FIG. 6 is a perspective view showing a portion of the high-rigidity member 38. As shown in FIG. 6, in the present embodiment, the lower surface of the connecting portion 58 in the high-rigidity member 38 of the first embodiment includes a plurality of (e.g., three) fins 60. Each fin 60 has the form of a rib and extends in the longitudinal direction of the connecting portion 58. Further, each fin 60 has a cross-section in the form of, for example, a reversed triangle. In the piston 14 of the present embodiment, the fins 60 on the lower surface of the connecting portion 58 increase the heat radiation surface and improve the cooling performance of the high-rigidity member 38. This limits decreases in the fatigue strength of the piston body 34 under high temperatures and reduces the formation of cracks in the crown of the piston body 34. The fins 60 of the high-rigidity member 38 increase the section modulus of the high-rigidity member 38 and improve the rigidity of the high-rigidity member 38.

Third Embodiment

Figure 7:
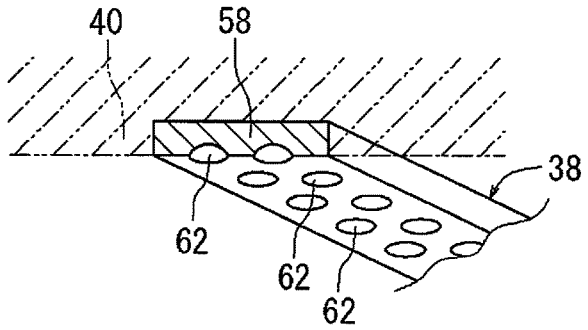
FIG. 7 is a partial perspective view of a high-rigidity member in a third embodiment.

The following description will focus on differences from the second embodiment. FIG. 7 is a perspective view showing a portion of the high-rigidity member 38. As shown in FIG. 7, in the present embodiment, the lower surface of the connecting portion 58 in the high-rigidity member 38 includes a vast number of dimples 62 instead of the fins 60 of the second embodiment. Each dimple 62 is concave and has a semispherical wall surface. In the piston 14 of the present embodiment, the dimples 62 in the lower surface of the connecting portion 58 increase the amount of held oil and improve the cooling performance of the high-rigidity member 38. This limits decreases in the fatigue strength of the piston body 34 under high temperatures and reduces the formation of cracks in the crown of the piston body 34.

Fourth Embodiment

Figure 8:
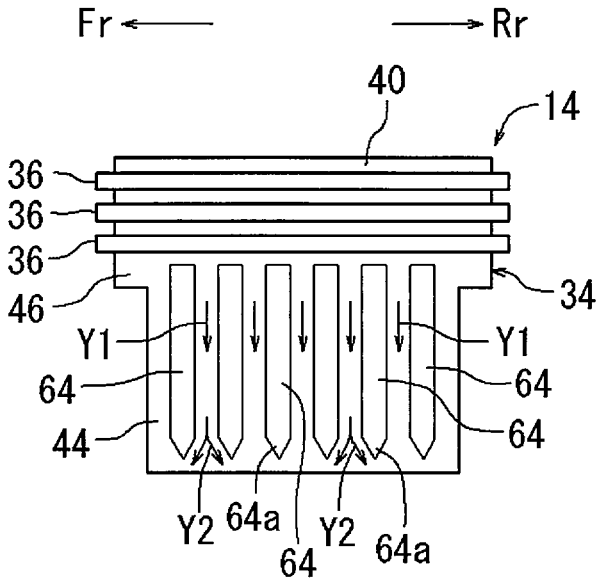
FIG. 8 is a side view of a piston in a fourth embodiment.

The following description will focus on differences from the first embodiment. FIG. 8 is a side view showing the piston 14. As shown in FIG. 8, in the present embodiment, the outer surface of each skirt 44 of the piston body 34 includes multiple (e.g., six) strips of resin-coated portions 64 extending in the vertical direction, that is, the axial direction of the piston body 34. Each resin-coated portion 64 includes a lower end 64*a* having the shape of a reversed triangle. The resin-coated portion 64 is formed by, for example, a resin film having a low coefficient of friction and containing molybdenum. Further, the resin-coated portion 64 has a thickness of, for example, approximately 10 μm.

In the piston 14 of the present embodiment, the resin-coated portions 64 on the outer surface of each skirt 44 decrease the coefficient of friction of the piston 14. This reduces friction loss of the piston 14. Further, the resin-coated portions 64 are formed as vertical strips. Thus, oil readily falls out from between adjacent resin-coated portions 64 (refer to arrows Y1 in FIG. 8). This reduces the amount of oil that rises along the skirts 44 and limits unnecessary oil consumption.

Further, the lower end 64*a* of each resin-coated portion 64 has the shape of a reversed triangle. Thus, oil may be readily discharged from between the adjacent resin-coated portions 64 (refer to arrows Y2 in FIG. 8). This further reduces the amount of oil that rises along the skirts 44 and effectively limits unnecessary oil consumption.

Figure 9:
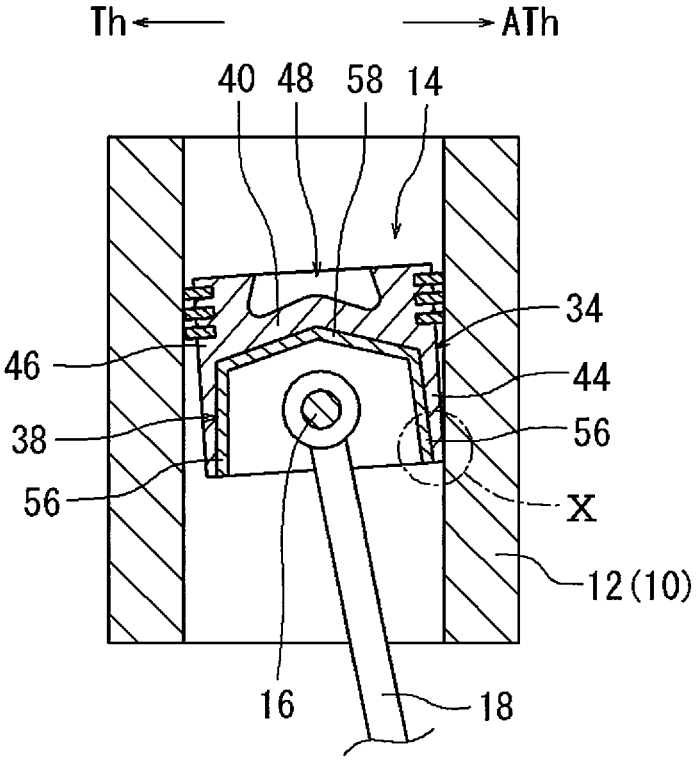
FIG. 9 is a diagram showing the rise of oil in a compression stroke of a diesel engine.
Figure 10:
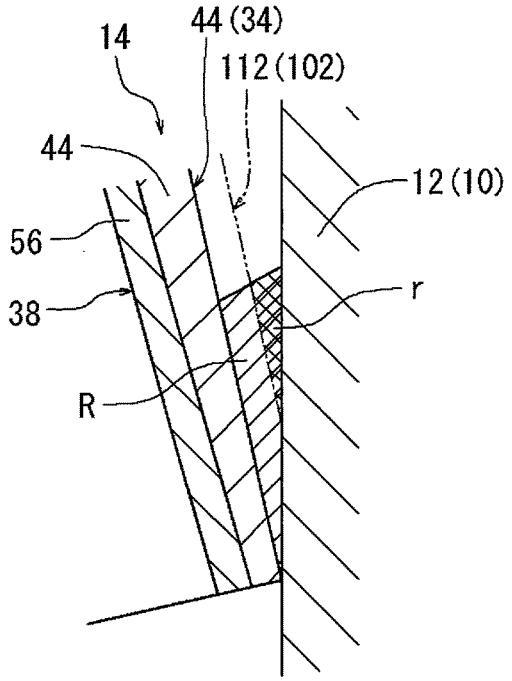
FIG. 10 is an enlarged view of the portion marked by X in FIG. 9.
Figure 11:
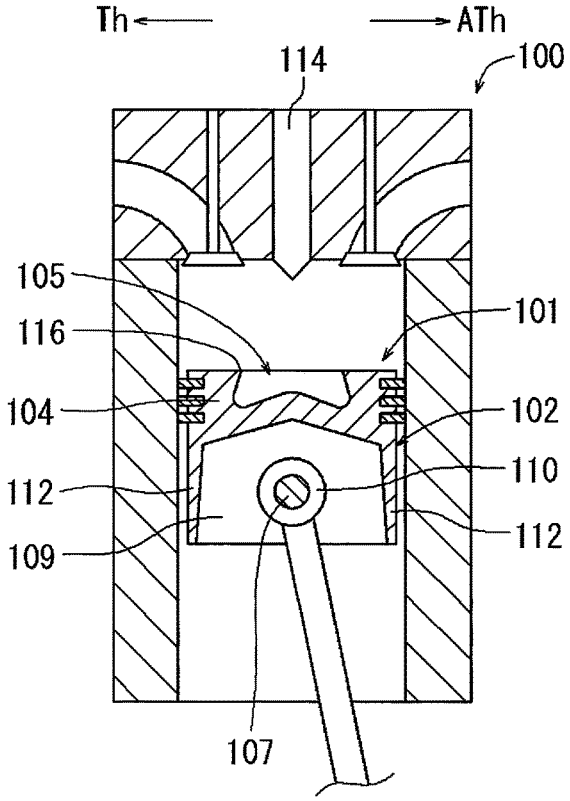
Fig.11 Prior Art
FIG. 11 is a cross-sectional view showing a prior art example of a diesel engine combustion chamber.

The operation and advantages of the piston 14 of the present embodiment will now be described in comparison with the piston 101 of the prior art example (refer to FIG. 11). FIG. 9 is a diagram showing the rise of oil in a compression stroke of a diesel engine 10. FIG. 10 is an enlarged view of the portion marked by X in FIG. 9. Referring to FIG. 9, during a compression stroke of the engine 10, the piston body 34 is tilted, and the lower end of the skirt 44 located at the anti-thrust side (ATh side) is forced against the wall of the cylinder 12. This elastically deforms the lower end of the skirt 44 located at the anti-thrust side (ATh side).

The piston body 34 of the present embodiment includes the high-rigidity member 38. This decreases the elastically deformed amount of the skirt 44 as compared with the elastically deformed amount of the skirt 112 in the prior art example (refer to FIG. 11). In the present embodiment, oil collects between the skirt 44 and the wall surface of the cylinder 12 where region R, which has a wedge-shaped cross-section, is defined (refer to hatched portion and meshed portion in FIG. 10). In the prior art, oil collects between the skirt 112 and the wall surface of the cylinder 12 where region r, which has a wedge-shaped cross-section, is defined (refer to meshed portion in FIG. 10). Region R where oil collects in the present embodiment is larger than region r where oil collects in the prior art example. Thus, it may be expected that the structure of the present embodiment increases the amount of rising oil and consumes unnecessary oil. It is assumed here that the piston 14 of the present embodiment is located at the same height as the piston 101 of the prior art example. Further, in FIGS. 9 and 10, the tilted amount of the piston 14 is shown in an exaggerated manner.

However, the piston 14 of the present embodiment includes the vertical strips of the resin-coated portions 64 so that oil readily falls out from region R (refer to arrows Y1 in FIG. 8). Further, the lower end 64*a* of each resin-coated portion 64 has the shape of a reversed triangle so that oil is readily discharged out of region R (refer to arrows Y2 in FIG. 8). Accordingly, the high-rigidity member 38 increases the rigidity of the piston body 34 and decreases the elastically deformed amount of the skirt 44. Further, the amount of oil that rises due to the decrease in the elastically deformed amount is reduced. This limits unnecessary oil consumption.

It should be apparent to those skilled in the art that the present invention may be embodied in many other specific forms without departing from the spirit or scope of the invention. Particularly, it should be understood that the present invention may be embodied in the following forms.

The present invention is not limited to the diesel engine 10 and may be a cylinder injection type gasoline engine. Further, the high-rigidity member 38 may be formed through casting. The high-rigidity member 38 may be entirely insert-casted in the piston body 34 so that the high-rigidity member 38 is hidden in the piston body 34. At least one leg 56 of the high-rigidity member 38 may be entirely insert-casted in the piston body 34 so that the leg 56 is hidden in the piston body 34. In the high-rigidity member 38, the width of the exposed surface of the connecting portion 58 may be changed. In addition or instead, the width of the exposed surface of at least one of the legs may be changed. In addition to or instead of the lower surface of the connecting portion 58, the fins 60 or the dimples 62 of the high-rigidity member 38 may be arranged in or on the inner surface of at least one of the legs 56. Further, reinforcement ribs may be formed on the upper surface of the connecting portion 58 of the high-rigidity member 38. In addition or instead, reinforcement ribs may be formed on the outer surface of at least one of the legs 56. The fins 60 do not need to be shaped to have a triangular cross-section. The fins 60 may be shaped to have a tetragonal cross-section, a semicircular cross-sectional, or the like. Further, the dimples 62 may be changed in shape.

The present examples and embodiments are to be considered as illustrative and not restrictive, and the invention is not to be limited to the details given herein, but may be modified within the scope and equivalence of the appended claims.

The invention claimed is:

1. A piston for an internal combustion engine, the piston comprising:

a piston body including:

a head including a recessed crown;

two side walls, each including a pin boss configured to support a piston pin; and two skirts, respectively located at a thrust side with respect to an axis of the piston pin and an anti-thrust side with respect to the axis of the piston pin; and a reinforcement member attached to the piston body, the reinforcement member including two legs and a connecting portion connecting upper ends of the two legs, wherein the two legs are respectively insert-casted in the two skirts, and the connecting portion is insert-casted in the head, the reinforcement member is formed from a material having a higher Young's modulus than a material of the piston body, the two skirts each include an outer surface, and the outer surface includes vertical strips of resin-coated portions, each of the resin-coated portions includes a first end located near the head and a second end opposite to the first end, the second end of each resin-coated portion is tapered so that a distance between the second ends of adjacent ones of the resin-coated portions is increased toward the second end from the first end.

2. The piston according to claim 1, wherein the reinforcement member includes an exposed surface, which is exposed to an inner void in the piston body, and the exposed surface of the reinforcement member includes fins.

3. The piston according to claim 1, wherein the reinforcement member includes an exposed surface, which is exposed to an inner void in the piston body, and the exposed surface of the reinforcement member includes dimples.

4. A piston for an internal combustion engine, the piston comprising:

a piston body including:

a head including a recessed crown;

two side walls, each including a pin boss configured to support a piston pin; and two skirts, respectively located at a thrust side with respect to an axis of the piston pin and an anti-thrust side with respect to the axis of the piston pin; and a reinforcement member attached to the piston body, the reinforcement member including two legs and a connecting portion connecting upper ends of the two legs, wherein the two legs are respectively insert-casted in the two skirts, and the connecting portion is insert-casted in the head, the two legs and the connecting portion each include an inner surface, which is exposed to an inner void in the piston body, and the inner surface includes dimples, the two skirts each include an outer surface, and the outer surface includes vertical strips of resin-coated portions, each of the resin-coated portions includes a first end located near the head and a second end opposite to the first end, and the second end of each resin-coated portion is tapered so that a distance between the second ends of adjacent ones of the resin-coated portions is increased toward the second end from the first end.

5. The piston according to claim 4, wherein the reinforcement member is formed from a material having a higher Young's modulus than the material of the piston body.

6. The piston according to claim 1, wherein the two legs each extend to an end of the corresponding skirt.

* * * * *